United States Patent [19]

Andersson

[11] 4,289,253

[45] Sep. 15, 1981

[54] METHOD FOR WARMING AND DAMPING OF NON-WOVEN, DISPOSABLE, STRENGTH TREATED NAPKINS OR TOWELS

[75] Inventor: Karl G. B. Andersson, Halmstad, Sweden

[73] Assignee: Duni Bila AB, Sweden

[21] Appl. No.: 839,312

[22] Filed: Oct. 4, 1977

Related U.S. Application Data

[63] Continuation of Ser. No. 672,649, Apr. 1, 1976, abandoned.

[30] Foreign Application Priority Data

Apr. 10, 1975 [SE] Sweden ..... 7504128

[51] Int. Cl.[3] ..... A47K 10/24

[52] U.S. Cl. ..... 221/1; 221/150 A

[58] Field of Search ..... 221/135, 150 A, 63, 221/96; 401/1; 118/43, 302, 315, 325; 21/81

[56] References Cited

U.S. PATENT DOCUMENTS

| | | | |
|---|---|---|---|
| 2,661,991 | 12/1953 | Petrecca | 222/135 X |
| 3,368,522 | 2/1968 | Cordis | 118/43 |
| 3,410,302 | 11/1968 | Frick | 221/63 |
| 3,775,801 | 12/1973 | Walker | 118/43 X |
| 3,947,134 | 3/1976 | Ogawa | 118/325 X |
| 3,986,479 | 10/1976 | Bonk | 118/43 X |

FOREIGN PATENT DOCUMENTS

| | | | |
|---|---|---|---|
| 1353465 | 5/1974 | United Kingdom | 221/96 |

*Primary Examiner*—F. J. Bartuska

*Attorney, Agent, or Firm*—Lerner, David, Littenberg & Samuel

[57] ABSTRACT

A method and device for warming and damping of disposable, wet strength treated napkins or towels are disclosed. The device comprises a plastic coated box blank which is folded into a trough having tight corner sections. The napkins or towels to be heated are placed in the trough and a quantity of water which has been heated to almost boiling is poured into the trough and over the napkins. The napkins can then be delivered for use in a warmed and damped condition.

1 Claim, 2 Drawing Figures

METHOD FOR WARMING AND DAMPING OF NON-WOVEN, DISPOSABLE, STRENGTH TREATED NAPKINS OR TOWELS

This is a continuation of application Ser. No. 672,649, filed Apr. 1, 1976 now abandoned.

BACKGROUND OF THE INVENTION

The napkins or rough towels usually used in aeroplanes are manufactured of terry cloth and the warming of these conventionally takes place in an oven. This is done so that a predetermined number of napkins are placed out on a tray of aluminum whereupon a certain amount of water is poured over the napkins on the tray and after that the tray is placed into the oven. When the napkins are served, it takes place directly from the tray, which is carried around to the passengers. The warming process as well as the serving of napkins have, however, appeared to be time-consuming and complicated. As the serving takes place from the tray, the napkins rapidly get cold, which is of the greatest disadvantage for the passengers last to be served, and at the same time the employees, when handling the tray, easily can get burnt. It is an object of the invention to provide a method and device of the type described above, by which the disadvantages mentioned are overcome.

SUMMARY OF THE INVENTION

This invention relates to a method and a device for warming and damping of non-woven, disposable, wet strength treated napkins or towels which are placed in a wrapping consisting of a plastic coated box blank folded to a trough with tight corner sections. The napkins are intended to be used in a warmed up and damped condition and especially in connection with travels by air, where the need has appeared particularly great owing to those special conditions prevailing in aeroplanes. According to the invention, a quantity of water chosen for the volume of the trough and for the substance of the napkins, and heated almost up to the boiling point, is poured into the trough and over the napkins. The napkins, after a short time can be taken out for use directly from the trough.

As a result of the instant invention, the warming of the napkins in an oven is now no longer necessary. One only heats water and after that pours it directly into the package. The napkins are then served directly from the package and therefore the napkins remain warm until the serving to the last passenger. At the same time, the risk of being burnt has been entirely eliminated.

DETAILED DESCRIPTION

Figure 1:
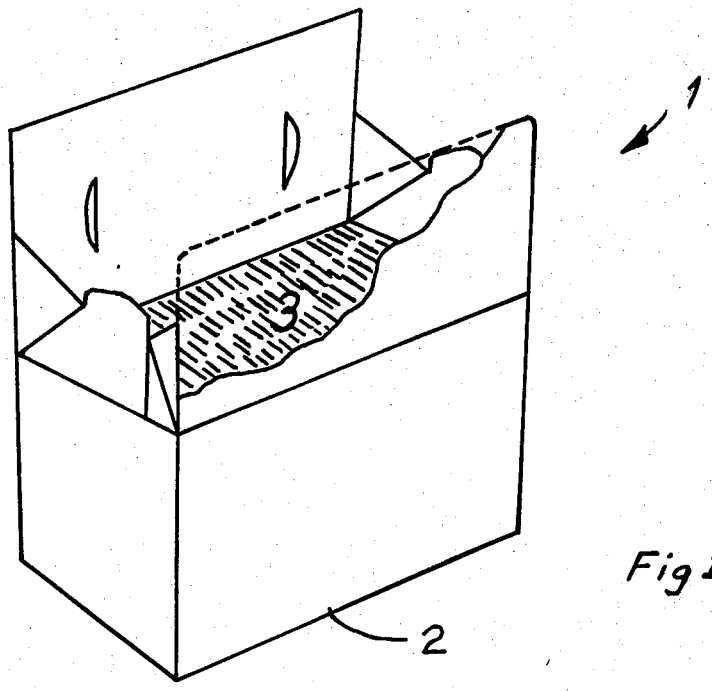
Figure 2:
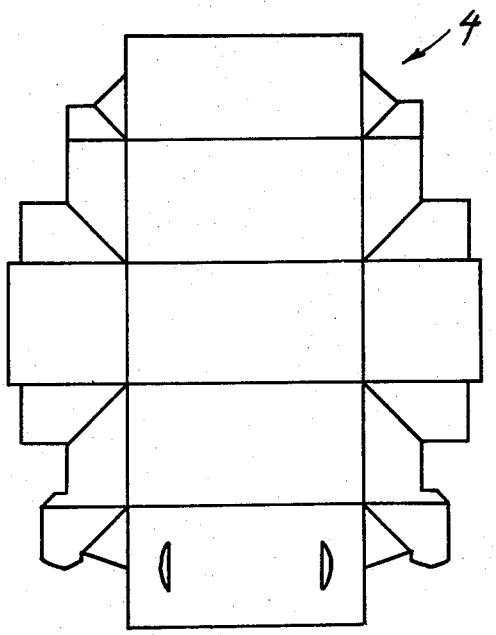

The invention will now be described by way of example only with particular reference to the accompanying drawings wherein:

FIG. 1 shows diagrammatically a perspective view of an opened package according to the present invention; and FIG. 2 shows a plan view of a box blank for the package illustrated in FIG. 1.

In FIG. 1 is diagrammatically illustrated a perspective view of a preferred embodiment of the package according to the invention. The package consists of a wrapping 2 containing a number of napkins or towels 3. The wrapping 2 is formed by an integral box blank 4 as shown in FIG. 2. The blank 4 is provided with a waterproof coating such as a plastic film of polyethylene, polypropylene, etc. Owing to this and as a result of the folding of the box blank 4 to a box or trough having tight corner sections, one obtains a package into which a liquid can be poured without leaking out.

The trough, in its erected condition, is kept together by a pressure heat seal. Other known sealants such as glue, staples, etc., can be used.

The napkins 3 are wet strength treated with, preferably, a polyamide aminoepichlorhydrin resin, which is sold on the open market under the trademarks KYMENE 557, UKADAN N, and NADAVIN FPN. The paper in the napkins may have a density of 10–60 g/m$^2$ and in this case consists of six layers of 28 g/m$^2$. The layers are laminated together by compression at a number of points.

Owing to the wet strength treatment of the napkins, a "fluffing" of the napkins is also eliminated. Such elimination is absolutely necessary if the napkins are intended to be used for wiping off the face.

By specifically choosing the quantity of water poured into the trough, one obtains napkins which in use have the desired dampness or wetness yet are not so wet that they drip. The desired effect described above is achieved if 1 liter of approximately 90° C. (194° F.) of water is poured into a package containing 30 dry napkins of several layers having a total weight of 450 grams. As the conductibility of paper is very bad, this package with its cover closed can now maintain the heat during approximately 15 minutes. When a napkin is dispensed, the napkin in use will have a temperature of approximately 70° C. and will function for at least 15 seconds, which is considered to be sufficient time for use.

As a further feature of the present invention, if desired, odorant tablets or perfumed liquids enclosed in caps of water soluble plastic may be added to the trough whereby a pleasant perfuming of the napkins can be obtained.

While the invention has been disclosed with a certain degree of particularity, it is to be understood that the present disclosure has been made by way of example only and that numerous variations as may become apparent to those skilled in the art may be made without departing from the spirit and scope of the invention as hereinafter claimed.

What is claimed is:

1. A method for warming and dampening of non-woven, disposable wet strength napkins or towels comprising:

providing a trough-shaped box having a waterproof coating therein and having water-tight corner sections and an open end;

placing a plurality of non-woven disposable wet strength treated napkins upright in said box in side by side relationship with one end of each of said napkins facing said open end of said trough-shaped box;

heating a predetermined quantity of water to approximately its boiling point;

pouring said predetermined quantity of heated water through said open end into said trough-shaped box over said plurality of napkins to collectively and completely warm and dampen said plurality of napkins in said trough-shaped box, said predetermined quantity of water being large enough so that each of said napkins is entirely dampened but small enough so that the napkins do not drip upon dispensing; and dispensing said dampened and warmed napkins directly from said trough-shaped box.

* * * * *